US006071168A

United States Patent [19]

Yang

[11] Patent Number: 6,071,168

[45] Date of Patent: Jun. 6, 2000

[54] MOTOR DRIVEN SURFACE TRANSLATING AMUSEMENT DEVICE

[75] Inventor: Chien-Nan Yang, Tainan, Taiwan

[73] Assignee: Dah Yang Toy Industrial Co., Ltd., China

[21] Appl. No.: 09/366,913

[22] Filed: Aug. 4, 1999

[51] Int. Cl.[7] ..... A63H 7/00

[52] U.S. Cl. ..... 446/269

[58] Field of Search ..... 446/269, 272, 446/280, 286, 287, 273, 274, 279, 288, 313, 384, 267, 325, 326, 396

[56] References Cited

U.S. PATENT DOCUMENTS

| | | | |
|---|---|---|---|
| 921,364 | 5/1909 | Clark | 446/353 |
| 3,060,631 | 5/1962 | Collischan | 446/301 |
| 4,073,087 | 2/1978 | Ieda | 446/435 |
| 5,184,569 | 2/1993 | Collins | 446/167 |

*Primary Examiner*—Robert A. Hafer
*Assistant Examiner*—Urszula M. Cegielnik
*Attorney, Agent, or Firm*—Fulwider Patton Lee & Utecht, LLP

[57] ABSTRACT

An amusement device includes a housing body having a bottom side formed with a rounded surface-contacting portion and a wheel slot that is disposed forwardly and that curves upwardly relative to the rounded surface-contacting portion. The top side of the housing body is formed with a link slot that extends above the wheel slot. A transmission mechanism is installed in the housing body, and includes a wheel that extends at a distance out of the housing body through the wheel slot. A connecting mechanism includes a driven link with an upper coupling end that extends outwardly of the housing body via the link slot. The connecting mechanism is coupled to and is driven by the transmission mechanism for moving the driven link to reciprocate along the link slot toward and away from a rear end of the link slot. A head member is mounted on the upper coupling end of the driven link.

9 Claims, 7 Drawing Sheets

MOTOR DRIVEN SURFACE TRANSLATING AMUSEMENT DEVICE

BACKGROUND OF THE INVENTION

1. Field of the Invention

The invention relates to an amusement device, more particularly to a motor driven surface translating amusement device.

2. Description of the Related Art

Toys can be generally classified as static toys or dynamic toys. Appearance is a primary design consideration for static toys. On the other hand, aside from considering their appearance, as to how movement of an animal or object can be simulated in order to achieve an amusement effect is also a primary design consideration for dynamic toys.

SUMMARY OF THE INVENTION

It is an object of the present invention to provide a motor driven surface translating amusement device that is capable of simulating the head movement of a bird, such as a duck or goose.

Another object of the present invention is to provide an amusement device of the aforesaid type, which is capable of translating on a surface when a head member thereof is extended forwardly.

According to the present invention, a motor driven surface translating amusement device comprises a housing body, a transmission mechanism, a connecting mechanism, and a head member.

The housing body has a top side and a bottom side formed with a rounded surface-contacting portion that has front and rear ends and that is adapted to be placed on a surface, a first upwardly curving portion that curves upwardly and rearwardly from the rear end of the rounded surface-contacting portion and that has an upper rear end, and a second upwardly curving portion that curves upwardly and forwardly from the front end of the rounded surface-contacting portion and that has an upper front end. The second upwardly curving portion is formed with a wheel slot that extends forwardly therealong and that curves upwardly relative to the rounded surface-contacting portion. The top side of the housing body has a rear portion that extends forwardly from the upper rear end of the first upwardly curving portion, and a front portion that extends forwardly from the rear portion toward the upper front end of the second upwardly curving portion. The front portion is formed with a link slot that extends forwardly therealong and that is disposed above the wheel slot.

The transmission mechanism is installed in the housing body, and includes a wheel that extends at a distance out of the housing body through the wheel slot.

The connecting mechanism includes a driven link with an upper coupling end that extends outwardly of the housing body via the link slot. The connecting mechanism is coupled to and is driven by the transmission mechanism for moving the driven link to reciprocate along the link slot toward and away from a rear end of the link slot.

The head member is mounted on the upper coupling end of the driven link.

When the driven link moves toward the rear end of the link slot, the head member is retracted relative to the housing body, and the weight center of the amusement device is shifted rearwardly to tilt the housing body rearwardly about the rounded surface-contacting portion and lift the wheel away from the surface.

When the driven link moves away from the rear end of the link slot, the head member is extended relative to the housing body, and the weight center of the amusement device is shifted forwardly to tilt the housing body forwardly about the rounded surface-contacting portion and bring the wheel into contact with the surface.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
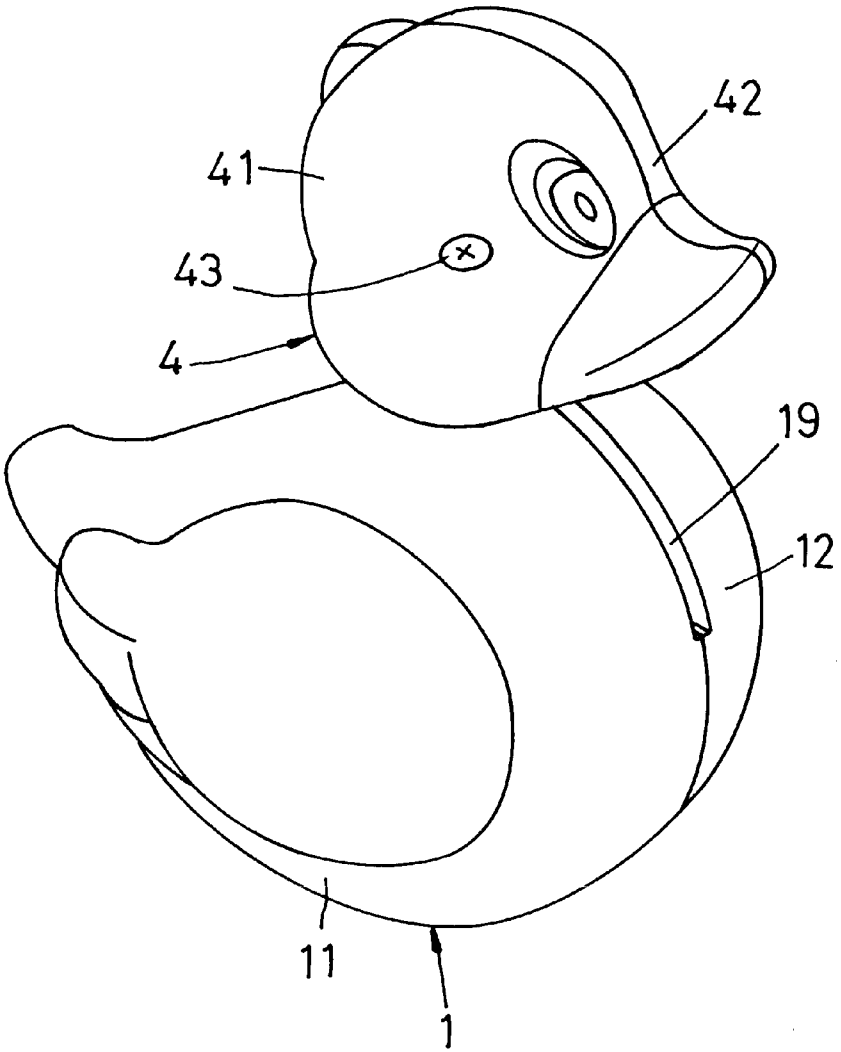
FIG. 1 is a perspective view illustrating the preferred embodiment of an amusement device according to the present invention.
Figure 2:
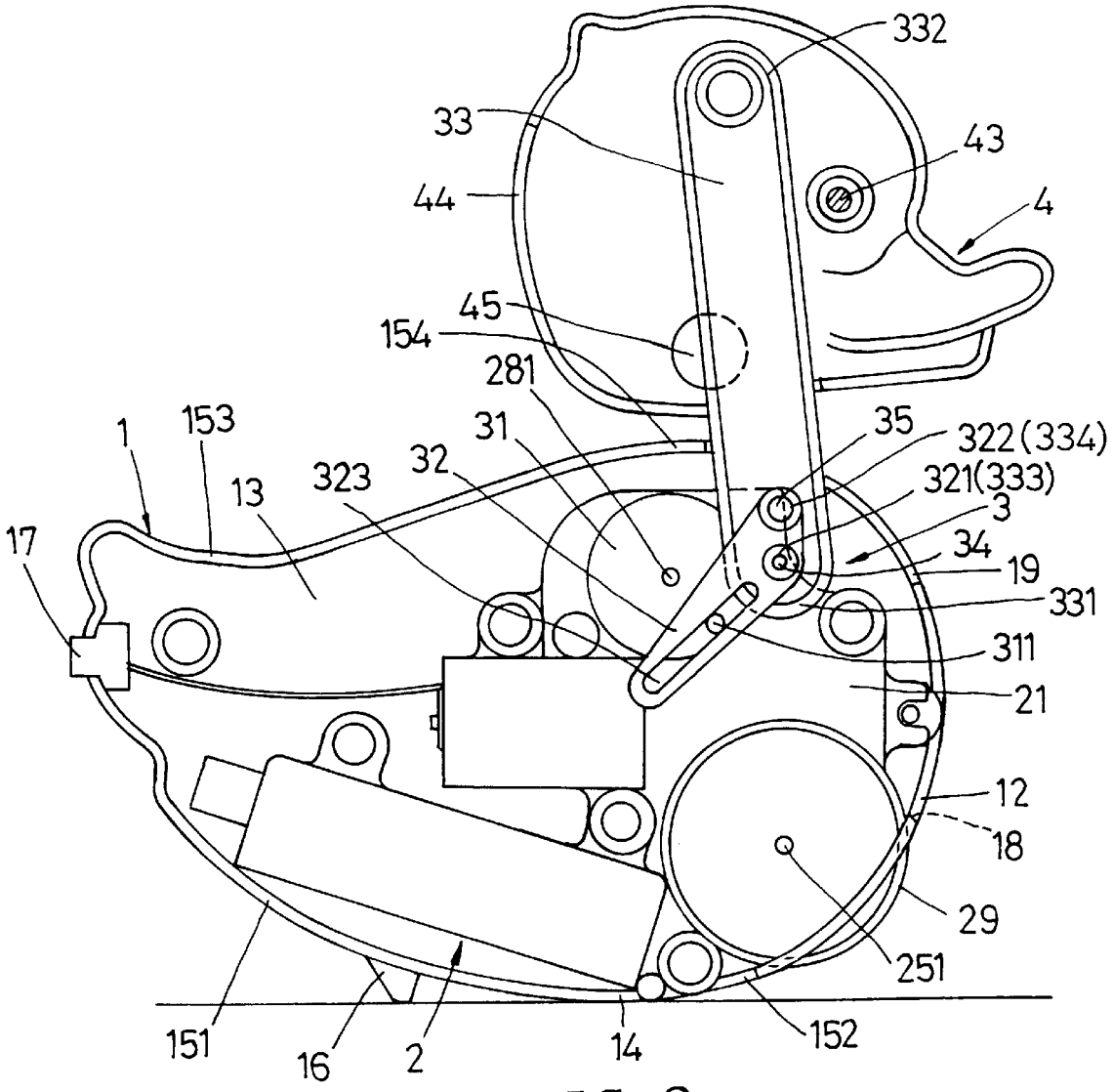
FIG. 2 is a schematic side view of the preferred embodiment with a left housing body part and a left head part removed.

Referring to FIGS. 1 and 2, the preferred embodiment of a motor driven surface translating amusement device according to the present invention is shown to be in the form of a simulated bird. In this embodiment, the amusement device is in the form of a simulated duck. It should be understood that the form of the amusement device may be modified into one of a simulated goose, or any other animal with a head that extends forward and that retracts rearward relative to the body, without departing from the spirit of the invention.

The amusement device includes a housing body 1, a transmission mechanism 2, a connecting mechanism 3 and a head member 4.

The housing body 1 includes complementary left and right housing body parts 11, 12 that are connected separably in a transverse direction of the housing body 1 and that cooperate to form a compartment 13. The housing body 1 has a bottom side formed with a rounded surface-contacting portion 14, a first upwardly curving portion 151 that curves upwardly and rearwardly from a rear end of the rounded surface-contacting portion 14, and a second upwardly curving portion 152 that curves upwardly and forwardly from a front end of the rounded surface-contacting portion 14. The first and second upwardly curving portions 151, 152 are spaced apart from each other in a longitudinal direction of the housing body 1. The housing body 1 further has a top side formed with a rear portion 153 and a front portion 154. The rear portion 153 extends forwardly from an upper rear end of the first upwardly curving portion 151. The front portion 154 extends forwardly from the rear portion 153 toward an upper front end of the second upwardly curving portion 152. The first upwardly curving portion 151 has a lower front end with a foot post 16 projecting downwardly therefrom. The foot post 16 and the rounded surface-contacting portion 14 cooperate to support the housing body 1 on a surface when the amusement device is in the initial state shown in FIG. 2. The upper rear end of the first upwardly curving portion 151, which forms the tail of the simulated duck, has a power switch 17 mounted thereon. The housing body parts 11, 12 are formed with left and right wheel slots 18 that extend forwardly along the second upwardly curving portion 152 and that curve upwardly relative to the rounded surface-contacting portion 14, and a link slot 19 that extends forwardly along the front portion 154 and that is disposed above the wheel slots 18.

Figure 3:
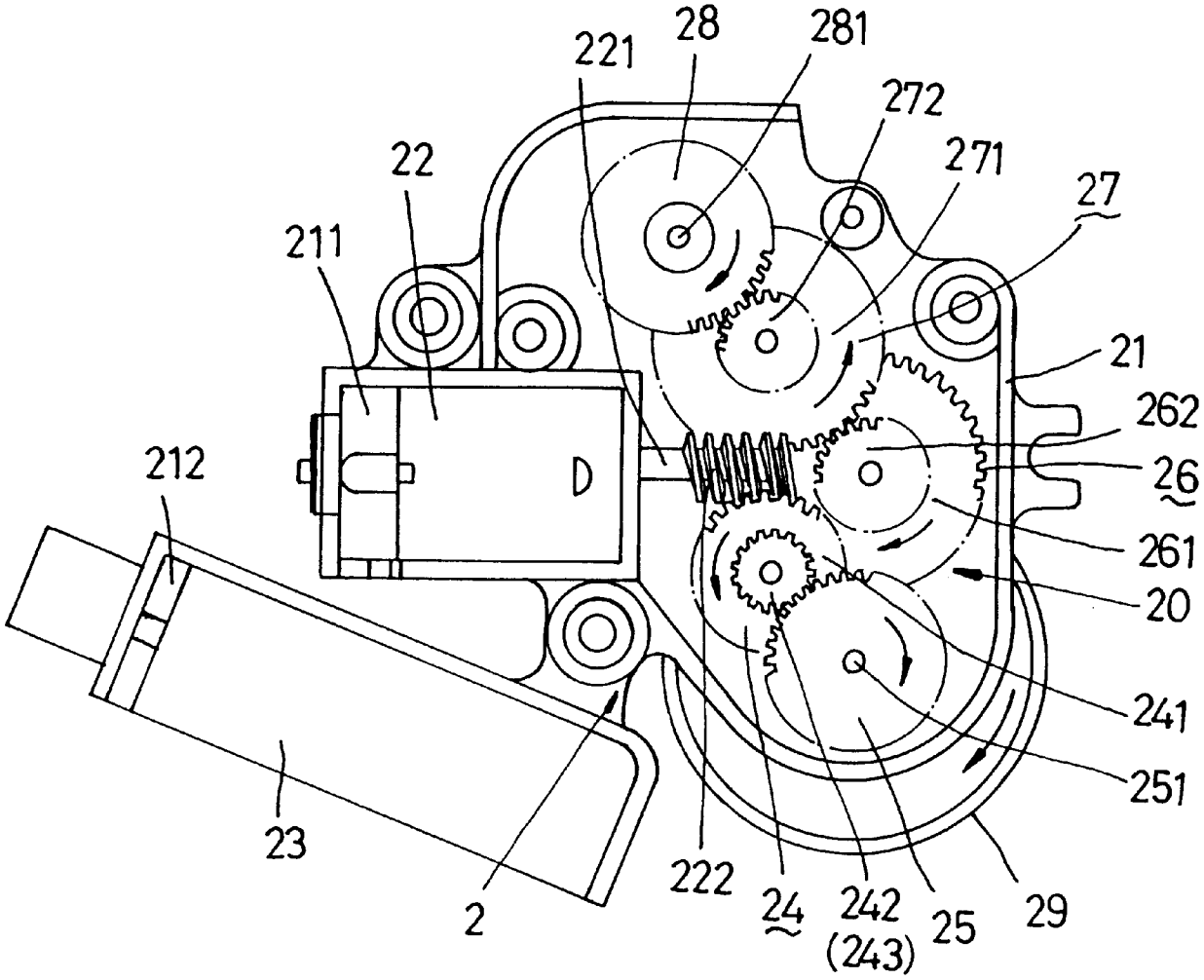
FIG. 3 is a planar view illustrating a transmission mechanism of the preferred embodiment.

Referring to FIGS. 2 and 3, the transmission mechanism 2 is installed in the compartment 13 of the housing body 1, and includes a gearing box 21 mounted inside the compartment 13. The gearing box 21 has a front section, and a rear section formed with a motor receiving space 211 and a battery receiving space 212 disposed below the motor receiving space 211. A driving motor 22 is mounted in the motor receiving space 211. At least one battery cell 23 is disposed in the battery receiving space 212. The motor 22 has a motor shaft 221 that extends forwardly and outwardly of the motor receiving space 211 into the front section of the gearing box 21. The motor shaft 221 is provided with a worm 222 thereon. A gear set 20 is mounted in the front section of the gearing box 21.

Figure 4:
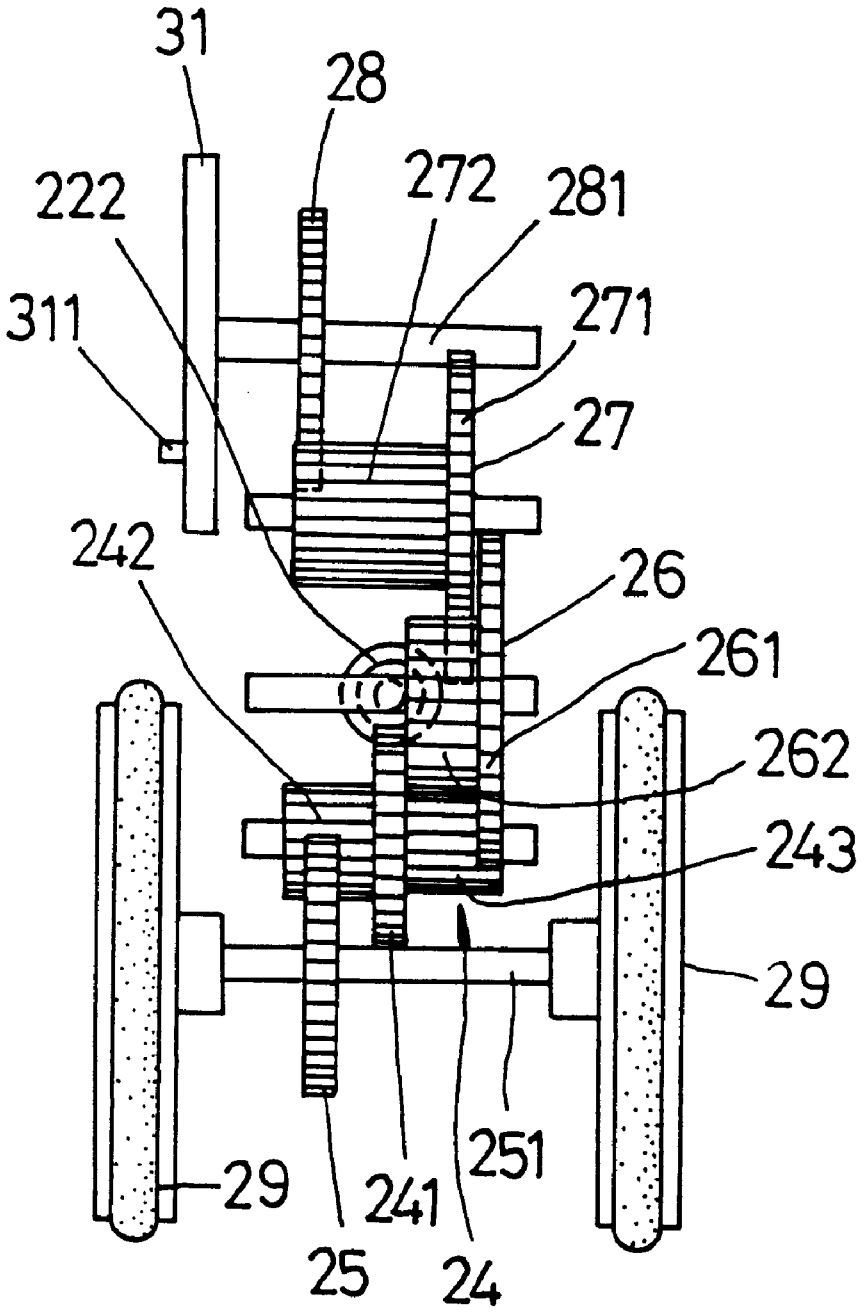
FIG. 4 is a schematic front view illustrating the transmission mechanism.

Referring to FIGS. 3 and 4, the gear set 20 includes a first gear unit 24 disposed below the worm 222, a wheel driving gear 25 disposed below and forwardly of the first gear unit 24, a second gear unit 26 disposed above the wheel driving gear 25, a third gear unit 27 disposed above and rearwardly of the second gear unit 26, and a terminating gear 28 disposed above and rearwardly of the third gear unit 27.

The first gear unit 24 includes a first gear portion 241 meshing with the worm 222, and second and third gear portions 242, 243 smaller than the first gear portion 241 in diameter and formed integrally, co-axially and respectively on left and right sides of the first gear portion 241. The second gear portion 242 meshes with the wheel driving gear 25. The wheel driving gear 25 is mounted securely and co-axially on a wheel axle 251 that extends in the transverse direction of the housing body 1. The wheel axle 251 has opposite ends that extend outside the gearing box 21. Each of the opposite ends of the wheel axle 251 has a wheel 29 mounted securely and co-axially thereon. When the gearing box 21 is installed inside the compartment 13 of the housing body 1, the wheels 29 extend at a distance out of the housing body 1 through a respective one of the wheel slots 18, as best illustrated in FIG. 2. The second gear unit 26 includes a large gear portion 261 that meshes with the third gear portion 243 of the first gear unit 24, and a small gear portion 262 that is formed integrally and co-axially on one side of the large gear portion 261 and that meshes with a large gear portion 271 of the third gear unit 27. The third gear unit 27 further includes a small gear portion 272 that is formed integrally and co-axially on one side of the large gear portion 271 and that meshes with the terminating gear 28. The second and third gear units 26, 27 cooperate to form a speed reduction gearing. The terminating gear 28 is mounted securely and co-axially on a gear axle 281 that extends in the transverse direction of the housing body 1. One end of the gear axle 281 extends outwardly of the gearing box 21 at the left side of the latter.

Figure 5:
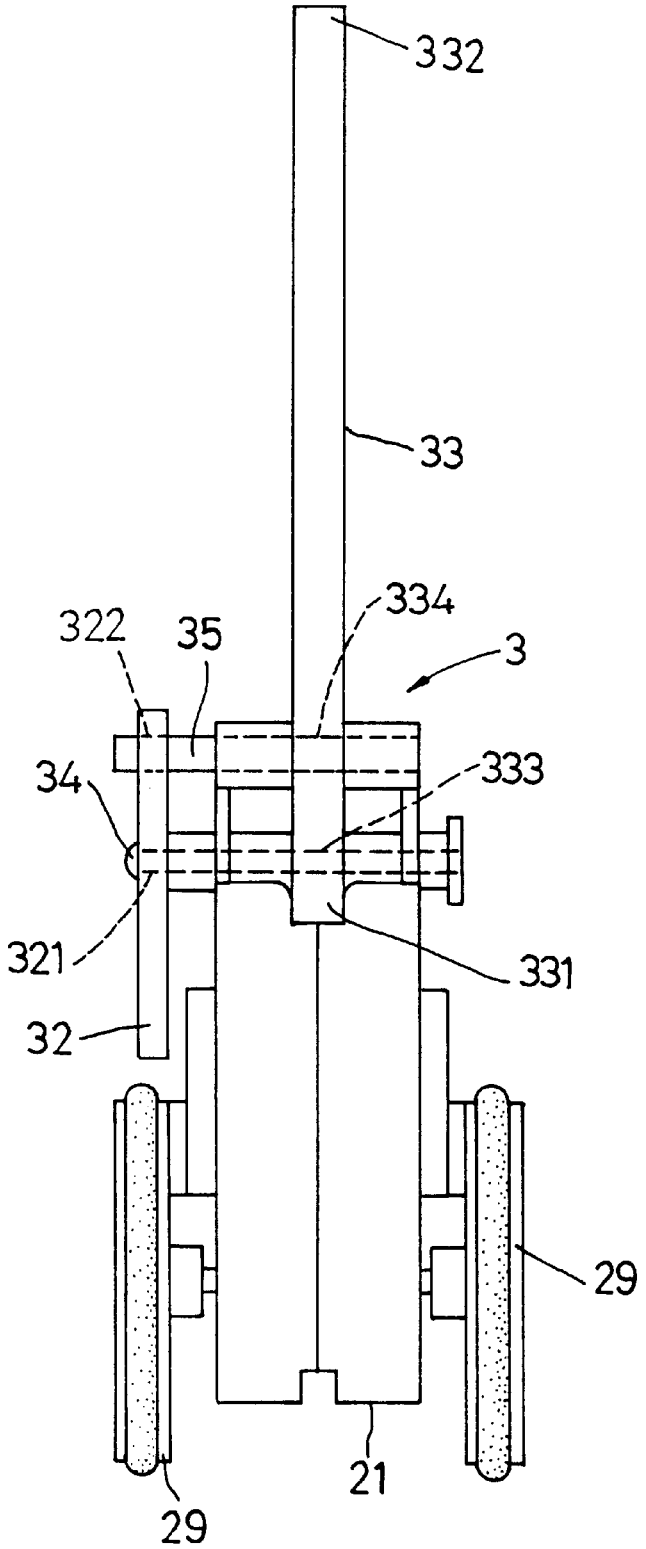
FIG. 5 is a schematic front view illustrating the relationship between the transmission mechanism and a connecting mechanism of the preferred embodiment.

Referring to FIGS. 2, 4 and 5, the connecting mechanism 3 includes a control wheel 31, a driving link 32, a driven link 33, a pivot pin 34, and a coupling pin 35.

The control wheel 31 is mounted securely on the gear axle 281 outside the gearing box 21, and is driven rotatably by the transmission mechanism 2. The control wheel 31 is provided with an eccentric pin 311 that extends in the transverse direction of the housing body 1 and that is offset from the gear axle 281, which serves as a rotary axis of the control wheel 31. In this embodiment, the driving link 32 is in the form of a generally triangular plate, and is formed with a pivot hole 321, a coupling hole 322 disposed above and forwardly of the pivot hole 321, and an elongate guide slot 323 that extends rearwardly relative to the pivot hole 321. The eccentric pin 311 extends into and movably engages the guide slot 323. The driven link 33 is in the form of an elongate plate having a lower connecting end 331 and an upper coupling end 332. The lower connecting end 331 is formed with first and second through holes 333, 334 aligned respectively with the pivot and coupling holes 321, 322. The pivot pin 34 extends through the pivot hole 321 and the first through hole 333, and mounts pivotally the driving link 32 and the driven link 33 on the gearing box 21. The coupling pin 35 extends through the coupling hole 322 and the second through hole 334 to interconnect the driving link 32 and the driven link 33. The upper coupling end 332 of the driven link 33 extends outwardly of the housing body 1 via the link slot 19.

Referring once again to FIGS. 1 and 2, the head member 4, which serves as the head of the simulated duck, includes complementary left and right head parts 41, 42 that are connected separably in the transverse direction of the housing body 1 via a screw fastener 43. The head member 4, which is hollow, has a bottom side with a rear section, a rear side that extends uprightly from a rear end of the rear section of the bottom side, and a link groove 44 that extends along the rear section of the bottom side and along the rear side of the head member 4. The upper coupling end 332 of the driven link 33 extends into the head member 4 via the link groove 44, and has the left and right head parts 41, 42 mounted pivotally thereon. In order to maintain the head member 4 in a horizontal state, each of the left and right head parts 41, 42 has an inner surface with a weighting member 45 mounted thereon.

Referring back to FIG. 2, in the initial state, the foot post 16 and the rounded surface-contacting portion 14 cooperate to support the housing body 1 on a flat surface. At this time, the wheels 29 are disposed higher than the rounded surface-contacting portion 14, and are thus not in contact with the flat surface. The driven link 33 is disposed proximate to a rear end of the link slot 19 such that the head member 4 is in a fully retracted position directly above the front portion 154 of the top side of the housing body 1. The head member 4 is in a horizontal state due to the presence of the weighting members 45.

Figure 6:
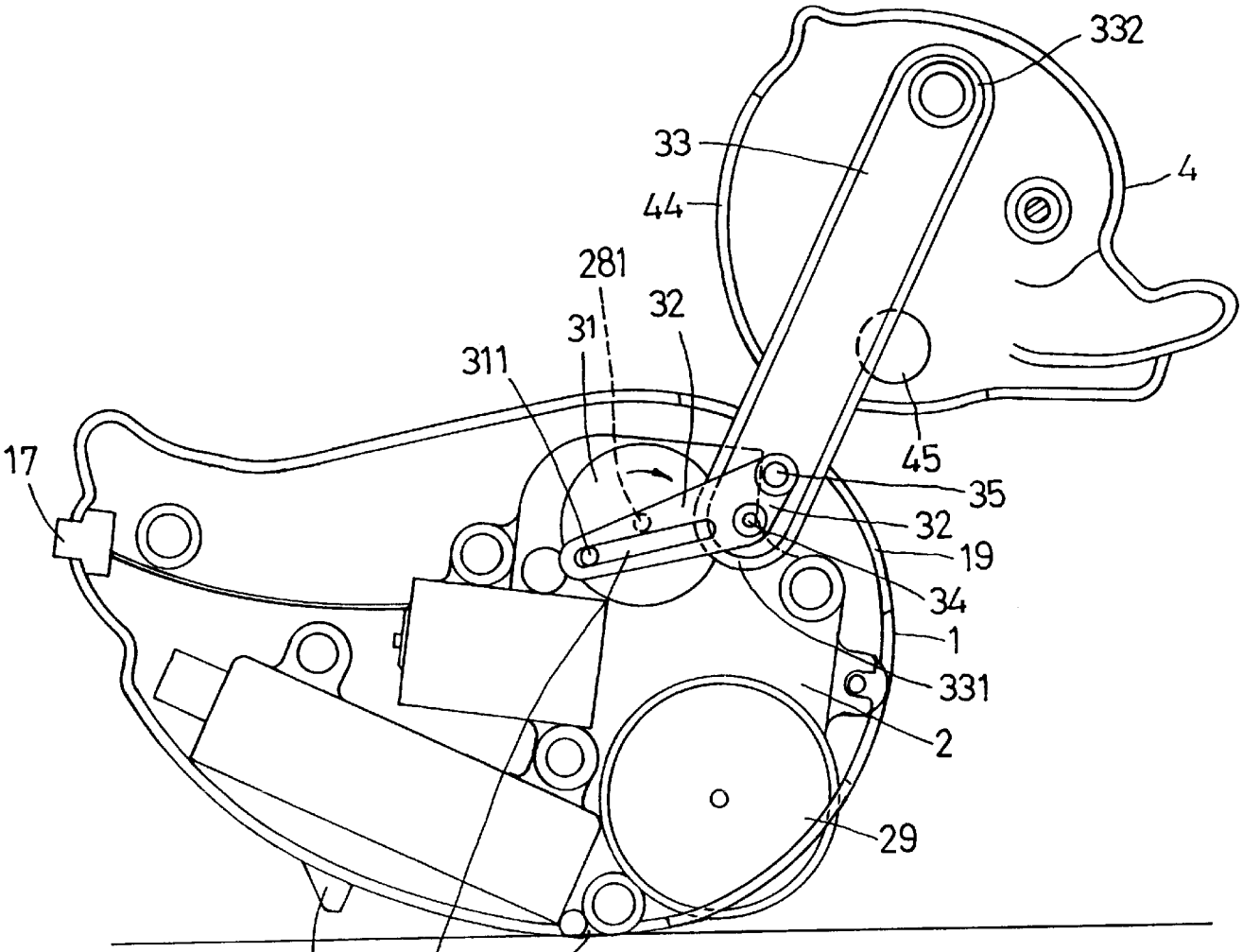
FIG. 6 is a view similar to FIG. 2, illustrating the head member in a semi-extended position.

With further reference to FIGS. 3, 4 and 6, when the power switch 17 is operated, the motor 22 is activated in a known manner, and the worm 222 rotates axially for counterclockwise rotation of the first gear unit 24. The following actions occur simultaneously upon rotation of the first gear unit 24:

1. The second gear portion 242 of the first gear unit 24 will drive rotation of the wheel driving gear 25, thereby rotating the wheel axle 251 and the wheels 29 on the opposite ends of the wheel axle 251 in the clockwise direction, as best shown in FIG. 3. The wheels 29 rotate idly as they are suspended above the flat surface at this time.

2. The third gear portion 243 of the first gear unit 24 will drive rotation of the second gear unit 26 in the clockwise direction, the second gear unit 26 will drive rotation of the third gear unit 27 in the counterclockwise direction, and the third gear unit 27 will drive rotation of the terminating gear 28, thereby rotating the gear axle 281 and the control wheel 31 in the clockwise direction.

Once the control wheel 31 rotates in the clockwise direction, the eccentric pin 311 will be rotated about the gear axle 281. Because the eccentric pin 311 extends into and movably engages the guide slot 323 in the driving link 32, initial rotation of the eccentric pin 311 will cause the driving link 32 to pivot about the pivot pin 34 in the clockwise direction. At this time, because the driving link 32 is connected to the driven link 33 via the coupling pin 35, the driven link 33 will be pushed by the driving link 32 to similarly pivot about the pivot pin 34 in the clockwise direction, thereby moving the driven link 33 away from the rear end of the link slot 19. Thus, the head member 4 moves forwardly relative to the housing body 1 to a semi-extended position, as best shown in FIG. 6.

Figure 7:
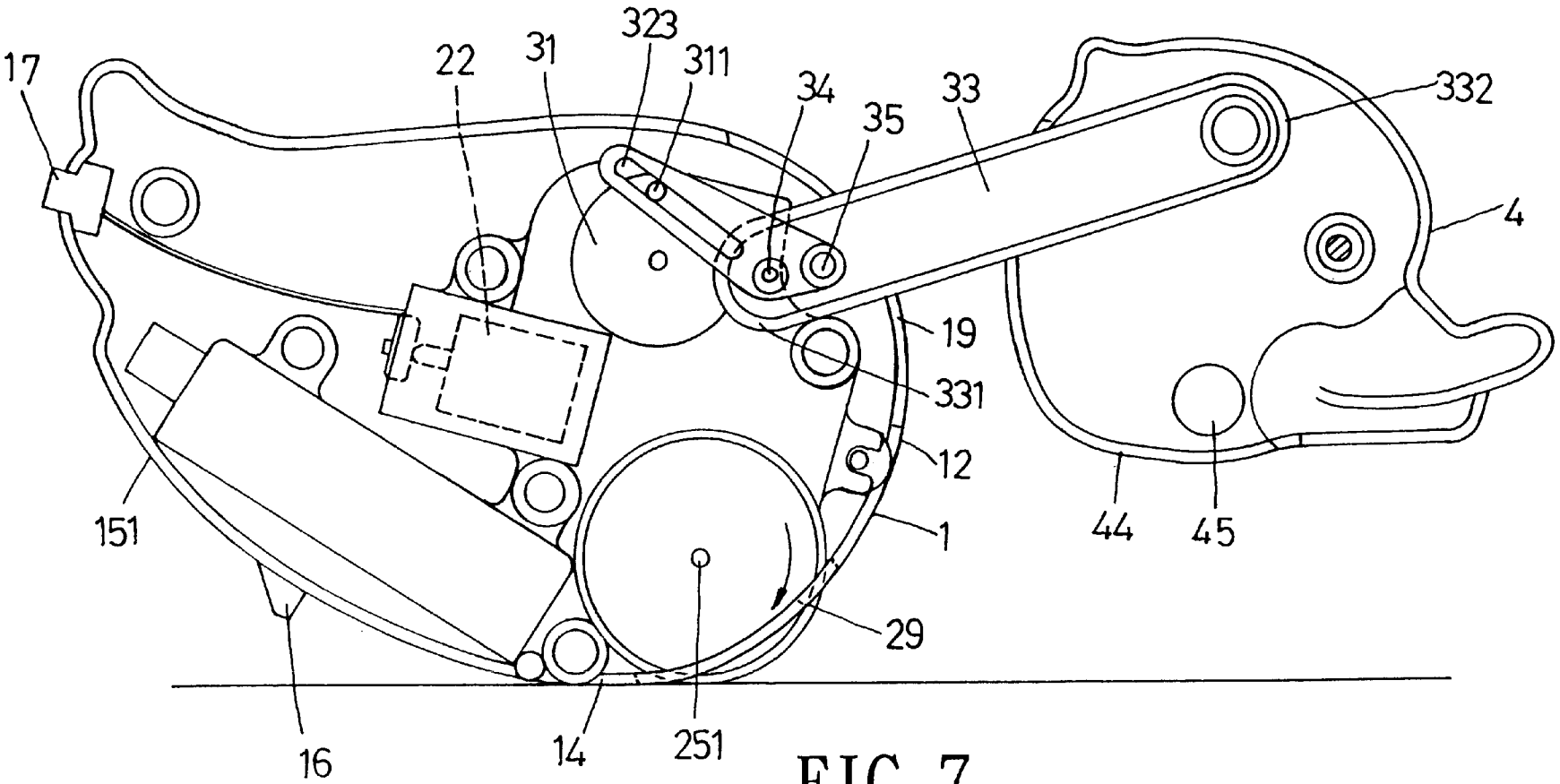
FIG. 7 is a view similar to FIG. 2, illustrating the head member in a fully extended position.

Referring now to FIGS. 3 and 7, when the head member 4 continues to move forwardly of the housing body 1 to a fully extended position due to continued operation of the motor 22, the weight of the head member 4 will shift the weight center of the amusement device forwardly and cause the housing body 1 to tilt forwardly about the rounded surface-contacting portion 14, thereby lifting the foot post 16 from the flat surface and bringing the wheels 29 into contact the flat surface. The housing body 1 will be dragged to translate forwardly along the flat surface at this time.

As the eccentric pin 311 continues to rotate, the driven link 33 will eventually be pulled by the driving link 32 to pivot about the pivot pin 34 in the counterclockwise direction, thereby pulling the driven link 33 toward the rear end of the link slot 19 such that the head member 4 moves rearwardly of the housing body 1 back to the semi-extended position shown in FIG. 6. The rearward shift in the weight center of the amusement device will cause the housing body 1 to tilt rearwardly about the rounded surface-contacting portion 14, thereby lowering the foot post 16 to the flat surface and lifting the wheels 29 away from the flat surface. Forward translation of the housing body 1 along the flat surface stops at this time. Further rotation of the eccentric pin 311 will move the driven link 33 and the head member 4 back to the fully retracted position shown in FIG. 2.

It has thus been shown that the head member 4 of the amusement device of this invention is movable from a fully retracted position to a semi-extended position, from the semi-extended position to a fully extended position, from the fully extended position back to the semi-extended position, and from the semi-extended position back to the fully retracted position. This reciprocating movement simulates that of an animal, such as a duck or goose, when in the act of feeding or eating. Surface translation of the amusement device occurs only when the head member 4 extends forwardly of the housing body 1. When the head member 4 moves rearwardly of the housing body 1 so as to be disposed directly above the same, the weight center of the amusement device is shifted rearwardly to stop further forward surface translation of the device.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

I claim:

1.A motor driven surface translating amusement device, comprising:

a housing body having a top side and a bottom side formed with a rounded surface-contacting portion that has front and rear ends and that is adapted to be placed on a surface, a first upwardly curving portion that curves upwardly and rearwardly from said rear end of said rounded surface-contacting portion and that has an upper rear end, and a second upwardly curving portion that curves upwardly and forwardly from said front end of said rounded surface-contacting portion and that has an upper front end, said second upwardly curving portion being formed with a wheel slot that extends forwardly therealong and that curves upwardly relative to said rounded surface-contacting portion, said top side of said housing body having a rear portion that extends forwardly from said upper rear end of said first upwardly curving portion, and a front portion that extends forwardly from said rear portion toward said upper front end of said second upwardly curving portion, said front portion being formed with a link slot that extends forwardly therealong and that is disposed above said wheel slot;

a transmission mechanism installed in said housing body and including a wheel that extends at a distance out of said housing body through said wheel slot;

a connecting mechanism including a driven link with an upper coupling end that extends outwardly of said housing body via said link slot, said connecting mechanism being coupled to and being driven by said transmission mechanism for moving said driven link to reciprocate along said link slot toward and away from a rear end of said link slot; and a head member mounted on said upper coupling end of said driven link;

movement of said driven link toward said rear end of said link slot retracting said head member relative to said housing body and shifting weight center of the amusement device rearwardly to tilt said housing body rearwardly about said rounded surface-contacting portion and lift said wheel away from the surface;

movement of said driven link away from said rear end of said link slot extending said head member relative to said housing body and shifting the weight center of the amusement device forwardly to tilt said housing body forwardly about said rounded surface-contacting portion and bring said wheel into contact with the surface.

2. The motor driven surface translating amusement device as claimed in claim 1, wherein said driven link further has a lower connecting end pivotally retained in said housing body, said connecting mechanism further including:

a control wheel driven rotatably by said transmission mechanism and provided with an eccentric pin offset from a rotary axis of said control wheel; and a driving link pivotally retained in said housing body and coupled to said lower connecting end of said driven link, said driving link being formed with an elongate guide slot, said eccentric pin extending into and movably engaging said guide slot;

whereby, rotation of said eccentric pin about the rotary axis of said control wheel results in pushing and pulling action of said driving link on said driven link for reciprocating said driven link along said link slot.

3. The motor driven surface translating amusement device as claimed in claim 2, wherein said transmission mechanism further includes:

a gearing box mounted inside said housing body;

a driving motor mounted inside said gearing box; and a gear set mounted inside said gearing box and including a gear unit driven rotatably by said driving motor, a wheel driving gear meshing with and being driven rotatably by said gear unit, said wheel driving gear being mounted securely on a wheel axle, said wheel axle having one end that extends outside said gearing box and that has said wheel mounted securely thereon, a speed reduction gearing meshing with and being driven rotatably by said gear unit, and a terminating gear meshing with and being driven rotatably by said speed reduction gearing, said terminating gear being mounted securely on a gear axle, said gear axle having one end that extends outside said gearing box and that has said control wheel mounted securely thereon.

4. The motor driven surface translating amusement device as claimed in claim 3, wherein said driving link and said lower connecting end of said driven link are mounted pivotally on said gearing box inside said housing body.

5. The motor driven surface translating amusement device as claimed in claim 1, wherein said second upwardly curving portion of said housing body is formed with left and right ones of said wheel slots, and said transmission mechanism includes left and right ones of said wheels that extend respectively through said left and right ones of said wheel slots.

6. The motor driven surface translating amusement device as claimed in claim 1, wherein said head member is formed as a hollow member, and has a bottom side formed with a link groove to permit extension of said upper coupling end of said driven link thereinto, said head member being mounted pivotally on said upper coupling end of said driven link.

7. The motor driven surface translating amusement device as claimed in claim 6, wherein said bottom side of said head member has a rear section with a rear end, said head member further having a rear side that extends uprightly from said rear end of said bottom side, said link groove extending along said rear section of said bottom side and along said rear side of said head member.

8. The motor driven surface translating amusement device as claimed in claim 6, wherein said head member has a weighting member mounted thereon.

9. The motor driven surface translating amusement device as claimed in claim 1, wherein said first upwardly curving portion further has a lower front end provided with a downwardly projecting foot post, said foot post being adapted to cooperate with said rounded surface-contacting portion to support said housing body on the surface when said head member is retracted relative to said housing body, and being lifted away from the surface when said head member is extended relative to said housing body.

* * * * *

UNITED STATES PATENT AND TRADEMARK OFFICE

CERTIFICATE OF CORRECTION

PATENT NO. : 6,071,168
DATED : June 6, 2000
INVENTOR(S) : Chien-Nan Yang

It is certified that error appears in the above-identified patent and that said Letters Patent is hereby corrected as shown below:

Title page,
Under "Assignee:", change "China", to read --Taiwan--.

Signed and Sealed this

Fourteenth Day of August, 2001

*Attest:*

Nicholas P. Godici

*Attesting Officer*

NICHOLAS P. GODICI
*Acting Director of the United States Patent and Trademark Office*